United States Patent [19]

Piestrup

[11] Patent Number: 4,763,344

[45] Date of Patent: Aug. 9, 1988

[54] X-RAY SOURCE FROM TRANSITION RADIATION USING HIGH DENSITY FOILS

[76] Inventor: Melvin A. Piestrup, 13800 Skyline Blvd., Woodside, Calif. 94062

[21] Appl. No.: 893,977

[22] Filed: Aug. 7, 1986

[51] Int. Cl.[4] ..... G21G 4/00

[52] U.S. Cl. ..... 378/119; 378/143

[58] Field of Search ..... 378/143, 119

[56] References Cited

PUBLICATIONS

V. L. Highland, "Some Practical Remarks on Multiple Scattering," Nucl. Instrum. Methods, vol. 129, pp. 497–499, 1975.

V. L. Ginzburg and I. M. Frank, "Radiation of a Uniform Moving Electron Due to its Transition from One Medium Into Another," J. Phys. (USSR) vol. 9, pp. 353–362, May 1945.

G. M. Garibyan, "Contribution to the Theory of Transition Radiation," Sov. Phys. JETP vol. 6, pp. 1079–1085, Jun. 1958.

M. L. Ter-Mikaelian, "Emission of Fast Particles in Heterogenious Medium," Nucl. Phys. vol. 24, pp. 43–66, Apr. 1961.

A. I. Alikhanyan, F. R. Arutyanyan, K. A. Ispiryan, and M. L. Ter-Mikaelian, "Possible Method of Detecting High-Energy Charged Particles," Sov. Phys. JETP, vol. 14, pp. 1421–1427, Jun. 1962.

M. L. Cherry, G. Hartman, D. Muller, and T. A. Prince, "Transition Radiation from Relativistic Electrons in Periodic Radiators," Phys. Rev. D vol. 10, pp. 3594–3607, Dec. 1974.

A. N. Chu, M. A. Piestrup, T. W. Barbee, Jr., and R. H. Pantell, "Transition Radiation as a Source of X-rays," J. Appl. Phys vol. 51, pp. 1290–1293, Mar. 1980.

A. N. Chu, M. A. Piestrup, T. W. Barbee, Jr., R. H. Pantell, and F. R. Buskirk, "Observation of Soft X-ray Transition Radiation from Medium Energy Electrons," Rev. Sci. Instrum. vol. 51, pp. 597–601, May 1980.

M. A. Piestrup, J. O. Kephart, H. Park, R. K. Klein, R. H. Pantell P. J. Ebert, M. J. Moran, B. A. Dahling, and B. L. Berman, "Measurement of Transition Radiation from Medium-Energy Electrons," Phys. Rev. A, vol. 32, pp. 917–927, Aug. 1985.

E. B. Hughes, H. D. Zeman, L. E. Campbell, R. Hofstadter, U. Meyer-Berkhout, J. N. Otis, J. Rolfe, J. P. Stone, S. Wilson, E. Rubenstein, D. C. Harrison, R. S. Kernoff, A. C. Thompson and G. S. Brown, "The Application of Synchrotron Radiation to Non-Invasive Anigiography," Nuc. Instr. and Meths. vol. 208(1983)665.

*Primary Examiner*—Carolyn E. Fields
*Assistant Examiner*—Joseph A. Hynds
*Attorney, Agent, or Firm*—Joseph H. Smith

[57] ABSTRACT

A bright, relatively inexpensive X-ray source (as compared to a synchrotron emitter) for scientific, technological, and medical purposes. A stack of foils of high density and moderate atomic number are bombarded with high-energy electrons of 25 to 500 MeV to produce a flux of transition X-rays of 2 keV or greater.

20 Claims, 9 Drawing Sheets

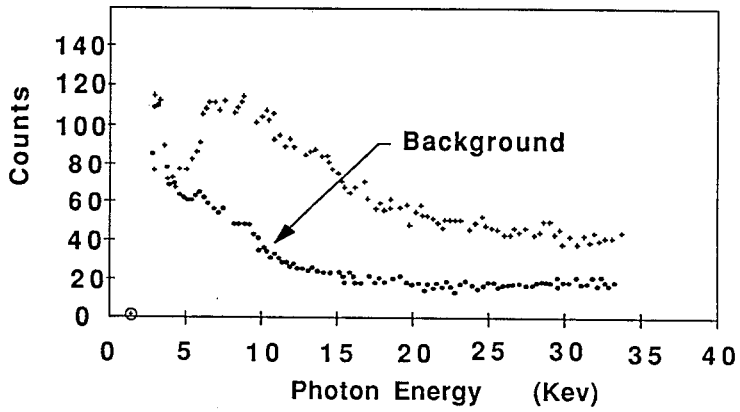
Figure 4. The measured number of counts for ten 1 - μm gold foils. The electron energy was 105 Mev The background emission from a single foil is also shown. The background emission is composed of Bremsstrahlung and other ionizing radiation originating from upstream of the foil stack and from the close proximity of the beam dump.

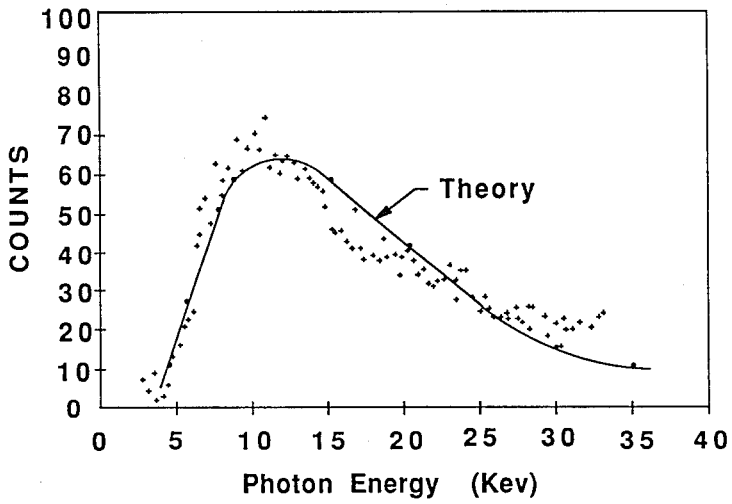
Figure 5. The relative number of counts from a transition radiator with the background subtracted. The electron - beam energy was 105 Mev and the radiator was ten 1 - μm foils of gold.

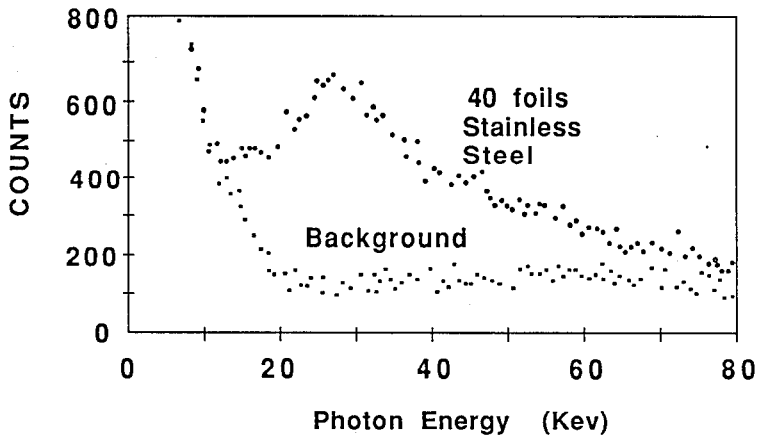
Figure 6. The measured pulse height count from 40 8.5 -μm foils of stainless steel. The electron beam energy was 500 Mev. The background was produced by a single 250 -μm stainless steel foil. The total charge through the single foil was adjusted so that emission from the foil and the stack could be compared.

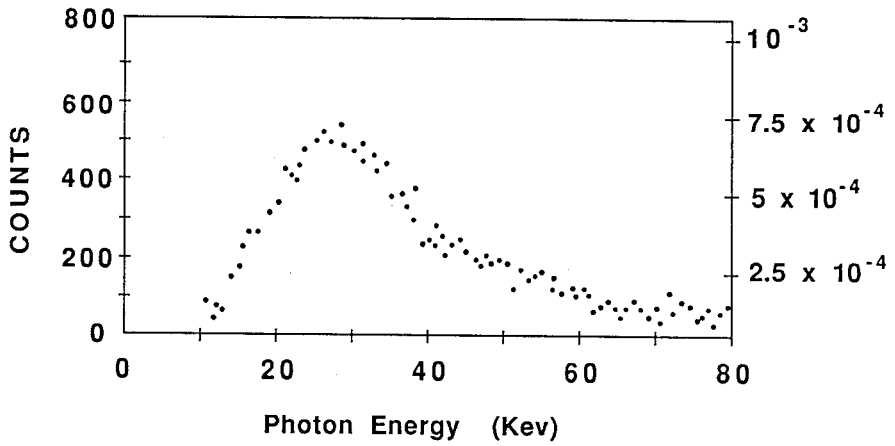
Figure 7. The absolute flux from 40 foils of 8.5 - μm stainless steel at 500 Mev with the background subtracted.

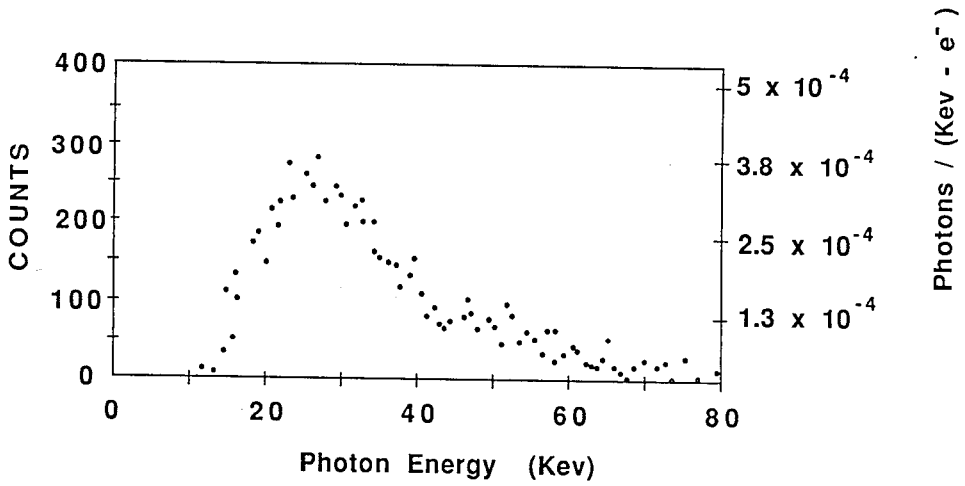
Figure 8. The absolute flux from a transition radiator with the background subtracted. The electron beam was 500 Mev and the radiator was 20 foils of 7.8 -μm copper.

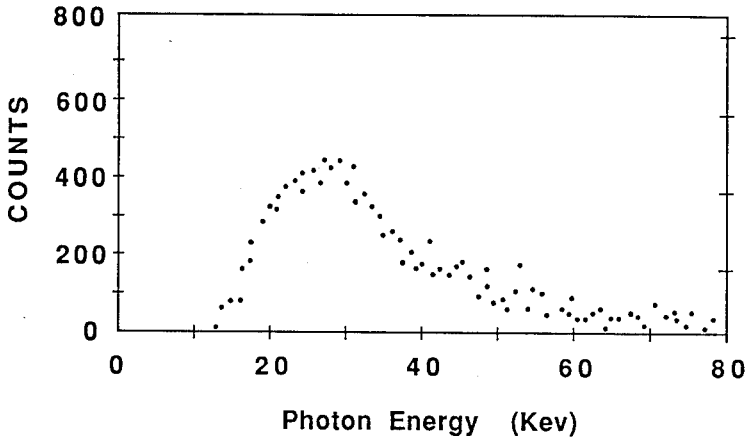
Figure 9. The relative number of counts from 40 foils of 8.5 - μm stainless steel at 400 Mev.

X-RAY SOURCE FROM TRANSITION RADIATION USING HIGH DENSITY FOILS

TECHNICAL FIELD

This invention relates to an apparatus for the production of X-rays for technological, scientific and medical purposes.

BACKGROUND OF THE INVENTION

For nearly a century X-rays for medical and technological use have been generated using bremsstrahlung and characteristic line emission. The intensity of this radiation is relatively weak for many commercial and medical applications. This is especially true for moving mechanical systems (e.g. gear trains) and biological tissue (e.g. arteries of the heart). In the past twenty years a brighter more collimated X-ray source from synchrotron emission has been used to generate both hard X-rays and soft X-rays for scientific and technological research. For example, very recent work using X-ray synchrotron emission from electron storage rigs offers the prospect of a new method of non-invasive coronary angiography (medical imaging of the arteries of the heart, see Hughes et al., "The application of synchrotron radiation to non-invasive angiography," Nuc. Instrum. Meth., vol. 208, p. 665, 1983). The high intensity and collimation of the synchrotron radiation permit the X-rays to be Bragg-diffracted so that only a narrow band of energies remain. The selected energy of the X-rays are subject to fine adjustment by small changes in the Bragg angle allowing digital subtraction of the X-ray images acquired at energies slightly above and below that of the iodine k-shell-photoabsorption edge at 33.16 keV, the iodine having been injected into the bloodstream intraveniously. This digital subtraction, called dichromography, substantially eliminates all image contrast due to other body structures and thereby achieves maximum contrast between the iodinated arteries and the surrounding tissue. Furthermore, when using the scanning method, the intensity of the synchronotron X-ray beams is such that the pairs of one-dimensional images, above and below the k-edge, can be recorded in a very short time. In this way, the prospect of visualizing the coronary arteries without motion artifacts is achieved. A conventional X-ray tube is generally not bright enough or collimated enough to achieve this kind of imaging in such a short time.

Unfortunately, the large storage rings with periodic magnetic fields for the generation of synchrotron radiation are presently extremely expensive. Estimated costs for such facilities are between 10 and 25 million dollars. A cheaper source is clearly needed.

Another source of X-rays is transition radiation from thin foils using electrons from high-current linear accelerators. Transition radiation occurs when charged particles encounter a sudden change in dielectric constant at the interface between dissimilar media (e.g. between a vacuum and a solid). Conservation of energy and momentum requires that a cone of X-rays be emitted.

In the prior art transition radiation has only been applied to high-energy-particle detection. Previously only low-density foils were used (densities $<2.25$ gm/cm$_3$), and, in order to raise the output photon frequency, the electron-beam energy was raised. For example, electron energies of 2 GeV or more were used with low-density foils such as mylar, lithium and beryllium. (see M. L. Cherry et al. "Transition radiation from relativistic electrons in periodic radiators," Phys. Rev. D vol. 10, pp. 3594–3607, December 1974.)

Transition radiation has also been considered as a source of soft X-rays (photon energy $<2$ keV) using low density ($\rho<3$ gm/cm$^3$) foils for lithography (see M. A. Piestrup et al. "Measurement of transition radiation from medium energy electrons", Phys. Rev. A, vol. 32. pp. 917–927, August 1985).

SUMMARY OF THE INVENTION

In accordance with the preferred embodiments of the invention, an intense, well-collimated-X-ray source is provided which uses thin high-density foils and in some applications relatively moderate electron-beam energies to generate X-ray radiation. The radiation is achieved through transition radiation. The source produces X-rays having an energy greater than 2 keV corresponding to a frequency of maximum photon flux, hereafter the peak frequency $\omega$, and uses a number of foils M arranged as a succession of parallel elements to form a stack. The foils are constructed of a material having an atomic weight A, a atomic number Z, and a density $\rho \geqq 3$ gm/cm$^3$, with each foil having a minimum thickness $l_2$. The foils are held together by a holding device which maintains a spacing $l_1$ between adjacent foils in the stack. An electron accelerator directs an electron beam towards the stack to create transition radiation, the electron beam having an energy $$E > E_o\omega \left[ \frac{Am_e}{4\pi N_o Z\rho e^2} \right]^{\frac{1}{2}} \tag{1}$$

but less than 500 MeV, where $E_o$ is the electron rest energy, $m_e$ is the mass of the electron, $N_o$ is Avogadro's number, and e is the electron charge. All units are in the cgs system. A housing provides a controlled environment for the electron beam and the foil stack. To produce the desired characteristics of the transition radiation, the number of foils $M \leqq (0.5)2/\mu l_2$, where $\mu$ is the absorption coefficient of the foil material at the frequency $\omega$. Also, $$l_2 \geqq \frac{\lambda}{(2/\gamma^2 + \omega_p^2/\omega^2)} \tag{2}$$

where $\lambda$ is the wavelength of the X-rays at the peak frequency $\omega$, and where $\gamma=(1-\beta^2)^{\frac{1}{2}}$ where $\beta$ is the velocity of the electrons in the electron beam relative to the speed of light, and $\omega_p$ is the plasma frequency of the foil material. The spacing between the foils $l_1$ is $$l_1 \geqq \frac{\gamma^2\lambda}{2} \tag{3}$$

if the housing provides a vacuum environment; and $$l_1 \geqq \frac{\lambda}{(2/\gamma^2 + \omega_{pg}^2/\omega^2)} \tag{4}$$

if the housing provides a gas environment, where $\omega_{pg}$ is the plasma frequency of the gas.

An objective of the invention is to make an economical X-ray source, as compared to a synchrotron emitter, in order to produce photon energies greater than 2 keV. To minimize the cost of construction and operation, the electron-beam energy is kept as low as possible. This is achieved by increasing the density of the foils. The photon emission falls off at the "cutoff" frequency, $\omega_c = E\omega_p/E_o$ (where $E_o$ is the electron rest mass, 0.511 MeV, $\omega_p$ is the plasma frequency of the foil material, and E is the energy of the electron beam). To keep $\omega_c$ as large as possible, while not increasing E, $\omega_p$ should be increased relative to the prior art values by going to high density materials since $\omega_p$ is proportional to the square root of the density. However, selection of higher density materials typically results in materials of higher atomic number Z.

Since bremsstrahllung is also emitted by the foils and is proportional to the square of the atomic number, bremsstrahlung can be large if Z is chosen to be too high. Hence, in some embodiments it is important to minimize the bremsstrahlung since it has a flat spectrum from very long wavelengths to photon energies equal to that of the electron-beam energy. Otherwise, extremely hard X-rays would be produced at high Z which are not desired and are detrimental to the X-ray optics and other experimental apparatus directly in line with the X-ray flux. Thus for some applications it is important to select foil materials with thicknesses and densities that minimize the bremsstrahlung and maximize the transition radiation. Selection of materials of high density and moderate Z is therefore desirable in these situations. For example, iron (stainless steel) and copper foils are excellent candidates since they have comparatively high densities and moderate atomic numbers.

High density foils which also have high Z such as gold or tungsten can be used in other embodiments if it is desirable to lower the electron beam energy further and if extremely hard bremsstrahlung contamination of the transition radiation spectrum does not matter. This would depend upon the X-ray optics and other experimental apparatus that might be effected by the extremely hard-X-ray emission.

Also the photon flux from the transition radiation source can be further increased by designing on the low-frequency side of the k-shell-absorption edge of the foil material. In this frequency band, there is a dramatic decrease in absorption of the X-rays in the foils themselves, thereby allowing the passage of the X-rays through a greater number of foils. This is accomplished by choosing the thickness of the foils $l_2$ to be:

$$l_2 = \frac{\lambda}{(2/\gamma^2 + \omega_p^2/\omega_k^2)} \pm 30\% \quad (5)$$

where $\omega_k$ is the k-shell photoabsorption-edge frequency of the foil material.

BRIEF DESCRIPTION OF THE DRAWINGS

FIG. 4. The measured number of counts for ten 1-μm gold foils. The electron-beam energy was 105 MeV. The background emission from a single foil is also shown. The background emission is composed of bremsstrahlung and other ionizing radiation originating from the upstream of the foil stack and from the close proximity of a beam dump.

FIG. 5. The relative number of counts from a transition radiation with the background subtracted. The electron-beam energy was 105 MeV and the radiator was ten 1-μm foils of gold.

FIG. 6. The measured pulse height count from 40 8.5 μm foils of stainless steel. The electron beam energy was 500 MeV. The background was produced by a single 250-μm stainless-steel foil. The total charge through the single foil was adjusted so that emission from the foil and the stack could be compared.

FIG. 7. The absolute flux from 40 foils of 8.5 μm stainless steel at 500 MeV with the background subtracted.

FIG. 8. The absolute flux from a transition radiator with the background subtracted. The electron beam was 500 MeV and the radiator was 20 foils of 7.8 μm copper.

FIG. 9. The the relative number of counts from 40 foils of 8.5-μm stainless steel at 400 MeV.

DETAILED DESCRIPTION OF THE INVENTION

Figure 1:
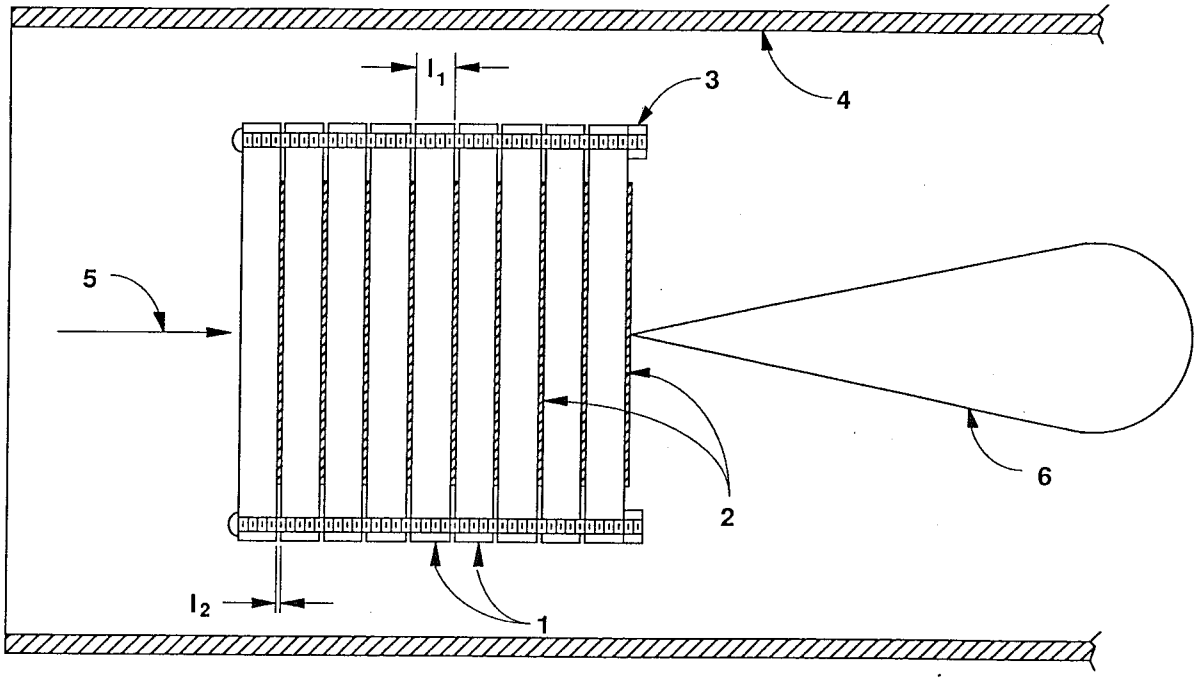
FIG. 1 shows an X-ray source according to the invention.

Shown in FIG. 1 is a foil stack typically constructed of thermally conductive metal rings 1 which support thin high-density foils 2, having a thickness $l_2$ of moderate atomic number, typically between 15 and 60. Foils of higher Z (Z>60) such as gold and tungsten may be used if extremely hard X-ray bremsstrahlung contamination of the transition radiation spectrum does not matter. The thickness of the foils typically ranges between 1 and 10 microns depending on the type of material used and the electron beam energy; however, this range is not intended to be restrictive. The formula for the minimum single foil thickness $l_2$ is obtained from A. N. Chu et al. "Transition radiation as a source of X-rays," J. Appl. Phys. vol 51, pp. 1290–1293, March 1980.

$$l_2 \geqq \frac{\lambda}{(2/\gamma^2 + \omega_p^2/\omega^2)} \quad (6)$$

where $\gamma = E/E_o$, is the electron beam energy, $E_o$ is the electron rest energy, $\omega$ is the X-ray photon frequency, $\lambda$ is the X-ray photon wavelength ($\lambda = 2\pi c/\omega$), and $\omega_p$ is the plasma frequency of the foil material. The foil thickness need not be exact, and can vary as much as 10 to 30% thinner than shown in the above equation without resulting in a large decreaes in photon emission from the foils. Hence as a preferred design criterion $l_2$ should be greater than the thickness $$(0.7)\frac{\lambda}{(2/\gamma^2 + \omega_p^2/\omega^2)} \quad (7)$$

The rings that hold the foils are held together firmly, for example with bolts 3 or other fastening devices and the rings are preferably water cooled. The foil stack itself typically resides in a vacuum in chamber 4 or in a gas of relatively low X-ray absorption. The thickness of the rings are such that they are rigid and provide adequate support for the thin foils, the rings typically being constructed of stainless steel or copper and having an optimum minimum thickness $l_1$ where:

$$l_1 \geqq \frac{\gamma^2\lambda}{2} \tag{8}$$

for a vacuum, or:

$$l_1 \geqq \frac{\lambda}{(2/\gamma^2 + \omega_{pg}^2/\omega^2)} \tag{9}$$

for a gas of plasma frequency $\omega_{pg}$. Typical values for $l_1$ range from 1 to 10 mm. The thickness of the rings determines the separation of the foils which is a key factor in the production of the X-ray photon flux at proper energy. Values of $l_1$ much less than the value given in the thickness formulas (50% or less) results in a marked decrease in the photon flux so that 50% is considered a practical minimum. Hence, as design criterion the two above equations for $l_1$ are multiplied by 0.5.

X-ray photons are produced when a well-collimated energetic electron beam 5 strikes the foil stack. As shown in FIG. 1, the electron beam is usually normal to the foil stack but this not necessary and can vary up to almost 90 degrees (angle with respect to the normal to the surface of the foil). The number of photons emitted per unit frequency per electron per interface integrated over all angles is given by the transition radiation equation:

$$\frac{dN}{d\omega} \simeq \left[\frac{2\alpha}{\pi\omega}\right]\left[\left(\frac{1}{2} + \frac{1}{b}\right)\ln(1 + b) - 1\right] \tag{10}$$

where $b=(\gamma\omega_p/\omega)^2$, $\gamma=E/E_o$, E is electron beam energy, $E_o$ is the rest energy (0.511 MeV) and $\omega_p$ is the plasma frequency of the foil material. The plasma frequency, $\omega_p$ is related to the foil density as follows:

$$\omega_p = \left[\frac{4\pi ZN_o\rho e^2}{m_e A}\right]^{\frac{1}{2}} \tag{11}$$

where A is the atomic weight of the foil material, $m_e$ is the electron mass, $\rho$ is the density of the foil material, $N_o$ is Avogadro's number, and e is the electron charge. The plasma frequency is seen to vary as $\rho^{\frac{1}{2}}$. As can be seen from the transition radiation equation, at $b^2<1$ or $\omega>\gamma\omega_p=E\omega_p/E_o$, the intensity drops rapidly to very small values. Thus $\omega_c=\gamma\omega_p$ can be viewed as a "cutoff" frequency above which the photon flux is too small to use.

In order to reduce construction costs and operational costs to an acceptable level, it is important to reduce the electron beam energy below 2 GeV since the principal cost of a source is the accelerator itself. This can be accomplished by using high density foils such as gold, stainless steel, and copper. With these foils, X-rays can be produced using electron-beam energies from 25 to 500 MeV. This can be seen from the "cutoff" frequency relation. Since $\omega<E\omega_p/E_o$ is required for good photon production, the electron beam energy is chosen to satisfy the following inequality:

$$E > E_o\frac{\omega}{\omega_p} = E_o\omega\left[\frac{m_e A}{4\pi ZN_o\rho e^2}\right]^{\frac{1}{2}} \tag{12}$$

where the formula for the plasma frequency has been substituted. As can be seen from this inequality, one can minimize E by going to foils of high density, $\rho$. The electron beam energy is selected to be large enough so that the cutoff inequality holds but the energy is kept to a reasonable value in order to minimize the expense of the accelerator, e.g. 25 to 500 MeV.

The number of foils, M, that can be used in stack 1 is limited only by the absorption in the foils themselves. To determine M, note that since the photon production is known to vary as $(1-\exp(-M\mu l_2)$, larger values of $M>2/\mu l_2$ will result in a saturation value for photon production (see A. N. Chu et al., "Transition radiation as a source of X-rays," J. Appl. Phys. vol 51, pp. 1290–1293, March 1980). Therefore, as an optimum if M is chosen to be approximately $2/\mu l_2$, the flux will be maximized. In practice this typically is between 10 and 100 foils. As a practical matter choosing M at 50% of the optimum results in only a small reduction in photon flux. So acceptable design criterion for M is $M\geqq(0.5)2/\mu l_2$.

Figure 2:
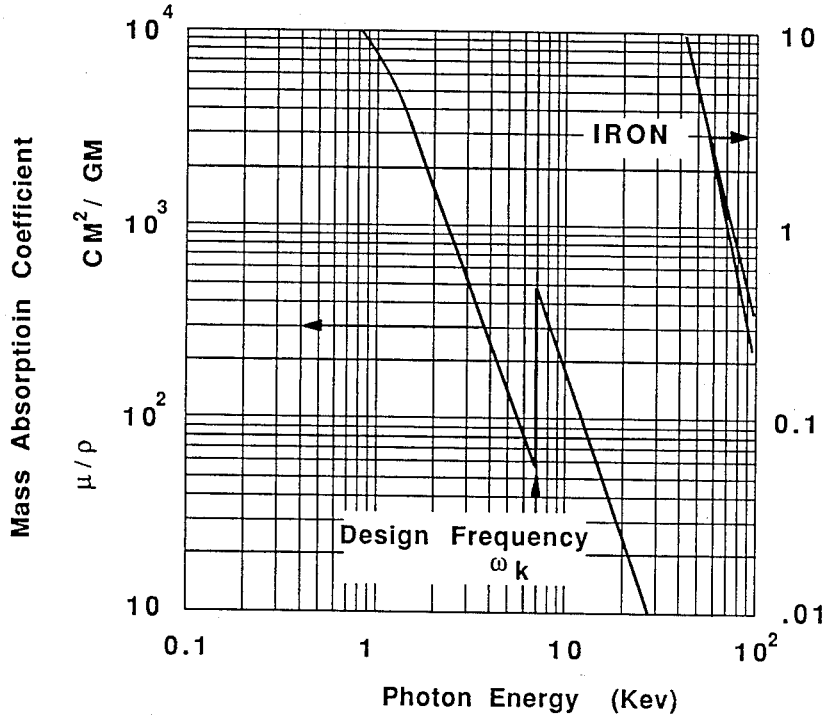
FIG. 2 The mass absorption coefficient of iron plotted as a function of photon energy in electron volts. The curve shows a sudden change in absorption at the K-shell photoabsorption edge at 7 keV.

The total photon flux can be further increased by designing the foil stack just below the k-shell photoabsorption frequency of the foil material. At the low frequency side of the k-shell-photoabsorption edge there is a dramatic decrease in photon absorption. For example, as shown in FIG. 2 for iron there is a sudden change in absorption at 7 keV. Thus a source can be designed with its peak photon production at the k-edge of the foil material. Given the k-edge frequency of the foil material and its plasma frequency, one picks a minimum electron beam energy for photon production from the condition that $E>E_o\omega/\omega_p$, where $\omega$ is the k-edge photon frequency. The optimum foil thickness is then calculated from the thickness equation, and the number of foils calculated from the condition $M\simeq 2/\mu l_2$, where $\mu$ is the lowest absorption value at the k-edge. As a design criterion, the foil thickness $l_2$ is chosen to be:

$$l_2 = \frac{\lambda}{(2/\gamma^2 + \omega_p^2/\omega_k^2)} \pm 30\% \tag{13}$$

since the photon production is somewhat insensitive to the foil thickness. However, the photon production is sensitive to the k-edge frequency. To choose a proper number of foils, the absorption coefficient is obtained at a frequency $\omega=\omega_o$ such that $\omega_k-\epsilon<\omega_o<\omega_k$ where $\epsilon=0.35\ \omega_k$ and $\omega_k$ is the k-edge frequency. This design criterion then recognizes the variability available in the number of foils.

Figure 3:
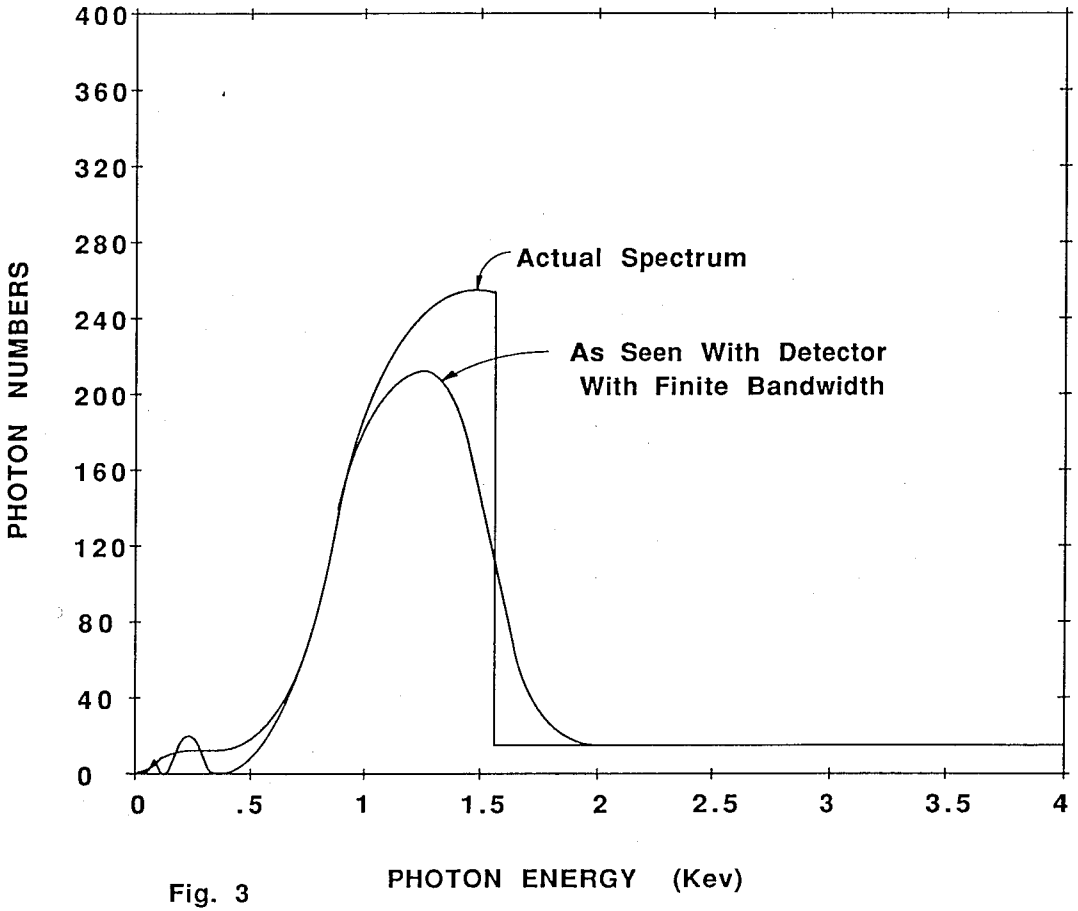
FIG. 3 Calculated effect of K-shell absorption on the transition-radiation spectrum for 54-MeV electrons. The aluminum spectrum is truncated above 1560 eV. The spectrum shown by the solid curve include the effect of the detector resolution; the dashed curves do not.

An added benefit of designing the foil stack at the k-edge is that the photon energy spectrum will be narrowed due to the sudden change in X-ray absorption. Such a more monochromatic source is often desired in many experimental situations, for example in angiography and microscopy. This case is illustrated in FIG. 3 for the soft X-ray region using aluminum, whose k edge is at 1.56 keV. The increases in absorption above the k edge results in a narrower energy spectrum that would otherwise be observed. Similar results are expected in the moderate to hard X-ray region.

It is also important to understand that the cone of X-ray emission for high-density foils is different from the low-density case, and results in a decrease in the number of photons per unit solid angle. Hence, careful design of the foil thickness and density is important. Without elastic scattering of the electrons with the foil atoms, the X-ray emission from single or multiple interfaces is in a tight forward cone with an apex angle of $\theta=1/\gamma$, and width $\Delta\theta=1/\gamma$, where $\gamma=(1-\beta^2)^{-\frac{1}{2}}$. For example, a 300-MeV-electron beam would produce angles $\theta\simeq\Delta\theta\simeq1.6$ mr. In general, this is true for low density foils; however, for the high desity foils considered here, the elastic scattering of the incoming electrons with the foil atoms results in a larger divergence of the exiting photon beam, and, hence, a decrease in photon density. Although photons are emitted at an angle of $1/\gamma$ relative to the individual electron trajectories, divergence of the electrons, $\Delta\theta_s$, results in an increase in the apex angle of the cone of emission:

$$\theta=(1/\gamma^2+\Delta\theta_s^2)^{\frac{1}{2}} \tag{14}$$

where the scattering is given by the scattering formula to be:

$$\Delta\theta_s = (12.5/E)\sqrt{Ml_2/X_o}\ \{1 + 0.125\log(Ml_2/0.1X_o)\} \tag{15}$$

where E is the electron beam energy in MeV, and $X_o$ is the radiation length of the foil material ($X_o=0.5$ cm for copper), see V. L. Highland, "Some practical remarks on multiple scattering," Nucl. Instrum. Meth., vol. 129, pp. 497–499 (1975).

Further complications in the development of a lower cost source of X-rays results from bremsstrahlung radiation, since bremstrahlung is also generated in the foils. For practical reasons, such as X-ray mirror damage and extremely hard X-ray contamination of possible experiments, this radiation should often be minimized. Assuming complete screening of the nuclear charge (valid for the frequency interval of those photons for which $\hbar\omega<<E$, where E is the electron beam energy), one obtains the double differential radiation cross section for relativistic bremsstrahlung:

$$\frac{dN}{dl} = 1.47\times 10^{-27}\eta_o\frac{\gamma^2Z^2}{\beta^2}\ln\left[\frac{233}{Z^{\frac{1}{3}}}\right]\left[\frac{1+\gamma^2\theta^2}{(1+\gamma^2\theta^2)^4}\right]\frac{d\omega}{\omega}\,d\Omega \tag{16}$$

where $n_o$ is the number of atoms per cubic centimeter, Z is the atomic number, and $\theta$ is the angle between the electron beam line and the observation point. In the prior art, bremsstrahlung was small because foils having low Z, and low density were used exclusively. However, since bremsstrahlung varies roughly as $Z^2$ when high density foils are used, the amount of bremsstrahlung can be large. However, the bremsstrahlung emission can be minimized by selecting foils of high density with only moderate atomic number. For example, for the case of 33 keV photon generation, stainless steel (Z=26) or copper (Z=29) foils are a better choice than tungsten (Z=74) or gold foils (Z=79). However, if relatively low energy accelerators are used, and a relatively high photon energy desired, these high density and large atomic number materials can be used provided that the extremely energetic photons from bremsstrahlung are not detremental to the desired use of the X-rays source. As shown in the experimental results illustrated in FIG. 4, gold foils can be used and produce a bremsstrahlung background of approximately half that of the transition radiation. Subtracting the background from the measured flux results in the transition-radiation flux which can be compare to the theoretical photon flux. This favorable comparison is illustrated in FIG. 5.

In another experiment stacks of stainless steel and copper have been shown to achieve a better ratio of transition radiation to bremsstrahlung radiation. The number of counts from a single 250-μm foil and from forty 8.5-μm stainless-steel-foils are presented in FIG. 6. The appearance of the large background is due to spurious radiation generated upstream of the foils. Subtracting these two spectra results in transition-radiation flux. Knowing the absolute magnitude of the charge that produced the flux, one can calculate the number of photons per unit bandwidth per electron, (photons/keV-electron). This is plotted as a scale on the right-hand side of FIGS. 7 and 8. In both cases the radiation at the peak is higher than expected from theoretical calculations (20% higher for copper and 30% for stainless steel). This high result is probably due to a low estimate on the number of electrons generated per pulse and not to any deviation from theory.

The same experiment was performed with a 400-MeV beam. The results using a stainless steel stack are presented in FIG. 9. Only the relative number of counts was measured for this case. Similar results were obtained.

These experiments prove that hard (30 keV) X rays can be generated from 100- to 500-MeV-electron beams using high density foils, and that transition radiation is a viable source for medical imaging such as angiography. Clearly for lower energy X-rays, lower electron source energies can be used and a practical cut off at the present time appears to be about 25 MeV.

What is claimed is:

1. A source for producing X-rays at an energy greater than 2 keV corresponding to a peak frequency $\omega$, comprising:

a number of foils, M, arranged as a succession of parallel elements to form a stack, the foils being constructed of a material having an atomic weight A, atomic number $15\leqq Z\leqq 79$, and a density $\rho\geqq 3$ gm/cm$^3$, with each foil having a minimum thickness $l_2$;

holding means for holding the foils in the stack and for maintaining a spacing $l_1$ between adjacent foils in the stack;

electron accelerating means for directing an electron beam toward the stack to create transition radiation, the electron beam having an energy $$E > E_o\omega\left[\frac{Am_e}{4\pi N_oZ\rho e^2}\right]^{\frac{1}{2}} \tag{17}$$

but less than 500 MeV, where $E_o$ is the electron rest energy, A is the atomic weight of the foil material, Z is the atomic number of the foil material, $m_e$ is the mass of the electron, $N_o$ is Avogadro's number, $\rho$ is the density of the foils, and e is the electron charge, all units in the cgs system;

housing means for providing a controlled environment for the electron beam and the foil stack;

where $M \geqq (0.5)2/\mu l_2$, where $\mu$ is the absorption coefficient of the foil material at the frequency $\omega$;

where $$l_2 \geqq (0.7)\frac{\lambda}{(2/\gamma^2 + \omega_p^2/\omega^2)} \quad (18)$$

where $\lambda$ is the wavelength of the X-rays at the peak frequency $\omega$, and where $\gamma=(1-\beta^2)^{\frac{1}{2}}$ where $\beta$ is the velocity of the electrons in the electron beam relative to the speed of light, and $\omega_p$ is the plasma frequency of the foil material;

where $$l_1 \geqq (0.5)\frac{\gamma^2\lambda}{2} \quad (19)$$

if the housing means provides a vacuum environment; and where $$l_1 \geqq (0.5)\frac{\lambda}{(2/\gamma^2 + \omega_{pg}^2/\omega^2)} \quad (20)$$

if the housing means provides a gas environment, where $\omega_{pg}$ is the plasma frequency of the gas.

2. A source as in claim 1 wherein the foil thickness $l_2$ satisfies the equation $$l_2 = \frac{\lambda}{(2/\gamma^2 + \omega_p^2/\omega_k^2)} \pm 30\% \quad (21)$$

where $\omega_k$ is the k-shell photoabsorption-edge frequency of the foil material.

3. A source as in claim 2 wherein the number of foils M is $$M \geqq (0.5)2/\mu_k l_2$$

where $\mu_k$ is the absorption coefficient of the foil material at a photon frequency $\omega=\omega_o$ where $\omega_k-\epsilon<\omega_o<\omega_k$ and $\epsilon=0.35\ \omega_k$.

4. A source as in claim 3 wherein $15 \leqq Z \leqq 60$.

5. A source as in claim 2 wherein $15 \leqq Z \leqq 60$.

6. A source as in claim 1 wherein $15 \leqq Z \leqq 60$.

7. A source as in claim 6 wherein $\rho \geqq 8.95$ gm/cm$^3$.

8. A source as in claim 6 wherein $\rho \geqq 7.9$ gm/cm$^3$.

9. A target for use with an electron beam for producing transition radiation at a peak frequency $\omega$, comprising:

a number of foils M arranged as a succession of parallel elements to form a stack, the foils being constructed of a material of atomic weight A, atomic number $15 \leqq Z \leqq 79$) and a density $\rho \geqq 3$ gm/cm$^3$, with each foil having a minimum thickness $l_2$;

holding means for holding the foils in the stack and for maitaining a spacing $l_1$ between adjacent foils in the stack;

the number of foils M is $M \leqq 2/\mu l_2$ where $\mu$ is the absorption coefficient of the foil material at frequency $\omega$;

the thickness $$l_2 \geqq \frac{\lambda}{(2/\gamma^2 + \omega_p^2/\omega^2)} \quad (22)$$

where $\lambda$ is the wavelength of the X-rays at the peak frequency $\omega$, and where $\gamma=(1-\beta^2)^{\frac{1}{2}}$ where $\beta$ is the velocity of the electrons in the electron beam relative to the speed of light, and $\omega_p$ is the plasma frequency of the foil material;

where $$l_1 \geqq \frac{\gamma^2\lambda}{2} \quad (23)$$

if the stack is used in a vacuum, and where $$l_1 \geqq \frac{\lambda}{(2/\gamma^2 + \omega_{pg}^2/\omega^2)} \quad (24)$$

if the stack is used in a gas, and $\omega_{pg}$ is the plasma frequency of the gas.

10. A target as in claim 9 wherein the foil thickness $l_2$ satisfies the equation $$l_2 = \frac{\lambda}{(2/\gamma^2 + \omega_p^2/\omega_k^2)} \pm 30\% \quad (25)$$

where $\omega_k$ is the k-shell photoabsorption-edge frequency of foil material.

11. A target as in claim 10 wherein the number of foils M is $$M \geqq (0.5)2/\mu_k l_2$$

where $\mu_k$ is the absorption coefficient of the foil material at a photon frequency $\omega=\omega_o$ where $\omega_k-\epsilon<\omega_o<\omega_k$ where $\epsilon=0.35\ \omega_k$.

12. A target as in claim 11 wherein $15 \leqq Z \leqq 60$.

13. A target as in claim 10 wherein $15 \leqq Z \leqq 60$.

14. A target as in claim 9 wherein $15 \leqq Z \leqq 60$.

15. A target as in claim 14 wherein $\rho \geqq 8.95$ gm/cm$^3$.

16. A target as in claim 14 wherein $\rho \geqq 7.9$ gm/cm$^3$.

17. A source as in claim 1 wherein $$M = 2/\mu l_2, \quad (26)$$

$$l_2 \geqq \frac{\lambda}{(2/\gamma^2 + \omega_p^2/\omega^2)}$$

and $$l_1 \geqq \frac{\gamma^2\lambda}{2} \quad (27)$$

if the housing means provides a vacuum environment; and $$l_1 \geqq \frac{\lambda}{(2/\gamma^2 + \omega_{pg}^2/\omega^2)} \quad (28)$$

if the housing provides a gas environment.

18. A source as in claim 17 wherein the foil thickness $$l_2 \geqq \frac{\lambda}{(2/\gamma^2 + \omega_p^2/\omega_k^2)} \quad (29)$$

where $\omega_k$ is the k-shell photoabsorption-edge frequency of the foil material.

19. A source as in claim 18 wherein the number of foils M is $M=2/\mu_k l_2$ where $\mu_k$ is the absorption coefficient of the foil material at a photon frequency $\omega=\omega_o$ where $\omega_k-\epsilon<\omega_o<\omega_k$ where $\epsilon=0.35\ \omega_k$.

20. A source for producing X-rays at an energy greater than 2 keV corresponding to a peak frequency $\omega$, comprising:

a number of foils, M, arranged as a succession of parallel elements to form a stack, the foils being constructed of a material having an atomic weight A, a atomic number $15 \leqq Z \leqq 79$, and a density $\rho$, with each foil having a minimum thickness $l_2$;

holding means for holding the foils in the stack and for maintaining a spacing $l_1$ between adjacent foils in the stack;

electron accelerating means for directing an electron beam toward the stack to create transition radiation, the electron beam having an energy $$E > E_o\omega\left[\frac{Am_e}{4\pi N_o Z\rho e^2}\right]^{\frac{1}{2}} \tag{30}$$

but less than 500 MeV, where $E_o$ is the electron rest energy, A is the atomic weight of the foil material, Z is the atomic number of the foil material, $m_e$ is the mass of the electron, $N_o$ is Avogadro's number, $\rho$ is the density of the foils, and e is the electron charge, all units in the cgs system;

housing means for providing a controlled environment for the electron beam and the foil stack;

$M \geqq (0.5)2/\mu l_2$, and $\mu$ is the absorption coefficient of the foil material at the frequency $\omega$;

where $$l_2 = \frac{\lambda}{(2/\gamma^2 + \omega_p^2/\omega_k^2)} \pm 30\% \tag{31}$$

and $\omega_k$ is the k-shell photoabsorption-edge frequency of the foil material, $\lambda$ is the wavelength of the X-rays at the peak frequency $\omega$, and where $\gamma=(1-\beta^2)^{\frac{1}{2}}$ and $\beta$ is the velocity of the electrons in the electron beam relative to the speed of light, and $\omega_p$ is the plasma frequency of the foil material; and $$l_1 \geqq (0.5)\frac{\gamma^2\lambda}{2} \tag{32}$$

if the housing means provides a vacuum environment; and $$l_1 \geqq (0.5)\frac{\lambda}{(2/\gamma^2 + \omega_{pg}^2/\omega^2)} \tag{33}$$

if the housing means provides a gas environment, and $\omega_{pg}$ is the plasma frequency of the gas.

* * * * *